US007824004B2

(12) United States Patent
Tokuno

(10) Patent No.: US 7,824,004 B2
(45) Date of Patent: Nov. 2, 2010

(54) LIQUID DISCHARGING DEVICE AND IMAGE FORMING APPARATUS

(75) Inventor: Toshiroh Tokuno, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 510 days.

(21) Appl. No.: 11/944,785

(22) Filed: Nov. 26, 2007

(65) Prior Publication Data

US 2008/0278538 A1 Nov. 13, 2008

(30) Foreign Application Priority Data

Nov. 27, 2006 (JP) ..... 2006-318106
Nov. 2, 2007 (JP) ..... 2007-286293

(51) Int. Cl.
*B41J 2/165* (2006.01)

(52) U.S. Cl. ..... 347/22; 347/33; 347/29; 347/30

(58) Field of Classification Search ..... 347/22–36, 347/104, 8, 37, 101
See application file for complete search history.

(56) References Cited

U.S. PATENT DOCUMENTS 4,935,753 A * 6/1990 Lehmann et al. ..... 347/33
6,695,443 B2 2/2004 Arita et al.
7,497,545 B2 * 3/2009 Shimizu ..... 347/22

FOREIGN PATENT DOCUMENTS

| | | | |
|---|---|---|---|
| JP | 403090362 A | * | 4/1991 |
| JP | 9-290511 | | 11/1997 |
| JP | 2001-205816 | | 7/2001 |
| JP | 2002-283581 | | 10/2002 |
| JP | 2002-356026 | | 12/2002 |
| JP | 2004-330546 | | 11/2004 |
| JP | 2005-22193 | | 1/2005 |
| JP | 3961206 | | 5/2007 |

* cited by examiner

*Primary Examiner*—Juanita D Stephens
(74) *Attorney, Agent, or Firm*—Cooper & Dunham LLP

(57) ABSTRACT

A liquid discharging device includes a liquid discharging head and a maintenance-recovery mechanism. In the liquid discharging head, a row of discharge openings is formed on a discharge opening surface. In the maintenance-recovery mechanism, a blade wipes the discharge opening surface. A belt carries the blade in a direction of rotation along the row of discharge openings. A pressing member presses an inner circumferential surface of the belt to move a portion of the belt opposing the liquid discharging head toward the liquid discharging head to maintain a substantially constant gap between the blade and the discharge opening surface. The gap has a length in the direction of rotation of the belt not smaller than a length of the row of discharge openings and not greater than a length of the liquid discharging head.

20 Claims, 15 Drawing Sheets

LIQUID DISCHARGING DEVICE AND IMAGE FORMING APPARATUS

BACKGROUND

1. Technical Field

The present specification describes a liquid discharging device and an image forming apparatus, and more particularly, a liquid discharging device and an image forming apparatus for discharging liquid onto a recording medium to form an image on the recording medium.

2. Discussion of the Background

An image forming apparatus, such as a copying machine, a printer, a facsimile machine, a plotter, or a multifunction printer having two or more of copying, printing, scanning, and facsimile functions, forms an image on a recording medium (e.g., a sheet) by discharging liquid. For example, the image forming apparatus includes a liquid discharging device for discharging liquid (e.g., an ink drop) onto a conveyed sheet. The ink drop is adhered to the sheet to form an image on the sheet. The liquid discharging device includes a liquid discharging head (e.g., a recording head) including a nozzle. The ink drop is discharged from the nozzle.

When ink having an increased viscosity, dried ink, or a foreign substance (e.g., dust) is adhered to an outer surface of the nozzle, the nozzle may be clogged. Similarly, when air bubbles are generated inside the nozzle, an ink drop may not be properly discharged from the nozzle.

To address these problems, a maintenance-recovery mechanism for maintaining the recovering reliability of the liquid discharging head is provided in the liquid discharging device. To do so, the maintenance-recovery mechanism may perform a sucking operation, a wiping operation, and a blank-discharge operation. In the sucking operation, a cap included in the maintenance-recovery mechanism caps the nozzle of the liquid discharging head and a pump connected to the liquid discharging head then sucks ink contained in the liquid discharging head through the nozzle. In the wiping operation, a wiper blade, included in the maintenance-recovery mechanism and formed of an elastic member such as rubber, wipes a nozzle surface of the liquid discharging head on which the nozzle is provided. In the blank-discharge operation, the liquid discharging head discharges ink not used for forming an image so as to remove ink having an increased viscosity and mixed-color ink from the inside of the nozzle and the outer surface of the nozzle. A combination of the sucking operation, the wiping operation, and the blank-discharge operation removes the ink having the increased viscosity, the foreign substance, and the air bubbles from the liquid discharging head, so that the liquid discharging head may discharge an ink drop properly and stably.

One example of the maintenance-recovery mechanism includes a wiper blade for wiping a liquid discharging surface of a liquid discharging head. A wiper holder holds the wiper blade such that the wiper blade wipes the liquid discharging surface by application of constant pressure on the liquid discharging surface.

Another example of the maintenance-recovery mechanism includes a blade for wiping a liquid discharging surface of a liquid discharging head. The blade is provided on an outer circumferential surface of a belt, and a platen contacts an inner circumferential surface of the belt.

To form an image at an increased speed, the image forming apparatus may include a long, liquid discharging head corresponding to a width of a sheet. To wipe the long, liquid discharging head, the belt carrying the blade needs to be long as well. However, such a long belt may be warped by gravity, and therefore the blade may not wipe a liquid discharging surface of the long, liquid discharging head by applying constant pressure on the liquid discharging surface. Moreover, even when the platen contacts the inner circumferential surface of the belt, the belt and the platen are longer than the long, liquid discharging head, and therefore, when the blade provided on the belt separates from the long, liquid discharging head, the blade, which is contacted and bent by the liquid discharging surface, is suddenly straightened and thereby may scatter liquid adhered to the blade.

SUMMARY

This patent specification describes a novel liquid discharging device. One example of a novel liquid discharging device includes a liquid discharging head and a maintenance-recovery mechanism. The liquid discharging head is configured to discharge a liquid drop, and includes a plurality of discharge openings arranged to form a row of discharge openings on a discharge opening surface. The maintenance-recovery mechanism is configured to maintain and recover a condition of the liquid discharging head, and includes a blade, a belt, and a pressing member. The blade is configured to wipe the discharge opening surface of the liquid discharging head. The belt is configured to carry the blade in a direction of rotation along the row of discharge openings. The pressing member is configured to press an inner circumferential surface of the belt to move a portion of the belt opposing the liquid discharging head toward the liquid discharging head to maintain a substantially constant gap between the blade and the discharge opening surface of the liquid discharging head. The gap has a length in the direction of rotation of the belt not smaller than a length of the row of discharge openings and not greater than a length of the liquid discharging head.

This patent specification further describes a novel image forming apparatus. One example of a novel image forming apparatus forms an image on a recording medium, and includes a liquid discharging device including a liquid discharging head and a maintenance-recovery mechanism. The liquid discharging head is configured to discharge a liquid drop onto a recording medium, and includes a plurality of discharge openings arranged to form a row of discharge openings on a discharge opening surface. The maintenance-recovery mechanism is configured to maintain and recover a condition of the liquid discharging head, and includes a blade, a belt, and a pressing member. The blade is configured to wipe the discharge opening surface of the liquid discharging head. The belt is configured to carry the blade in a direction of rotation along the row of discharge openings. The pressing member is configured to press an inner circumferential surface of the belt to move a portion of the belt opposing the liquid discharging head toward the liquid discharging head to maintain a substantially constant gap between the blade and the discharge opening surface of the liquid discharging head. The gap has a length in the direction of rotation of the belt not smaller than a length of the row of discharge openings and not greater than a length of the liquid discharging head.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
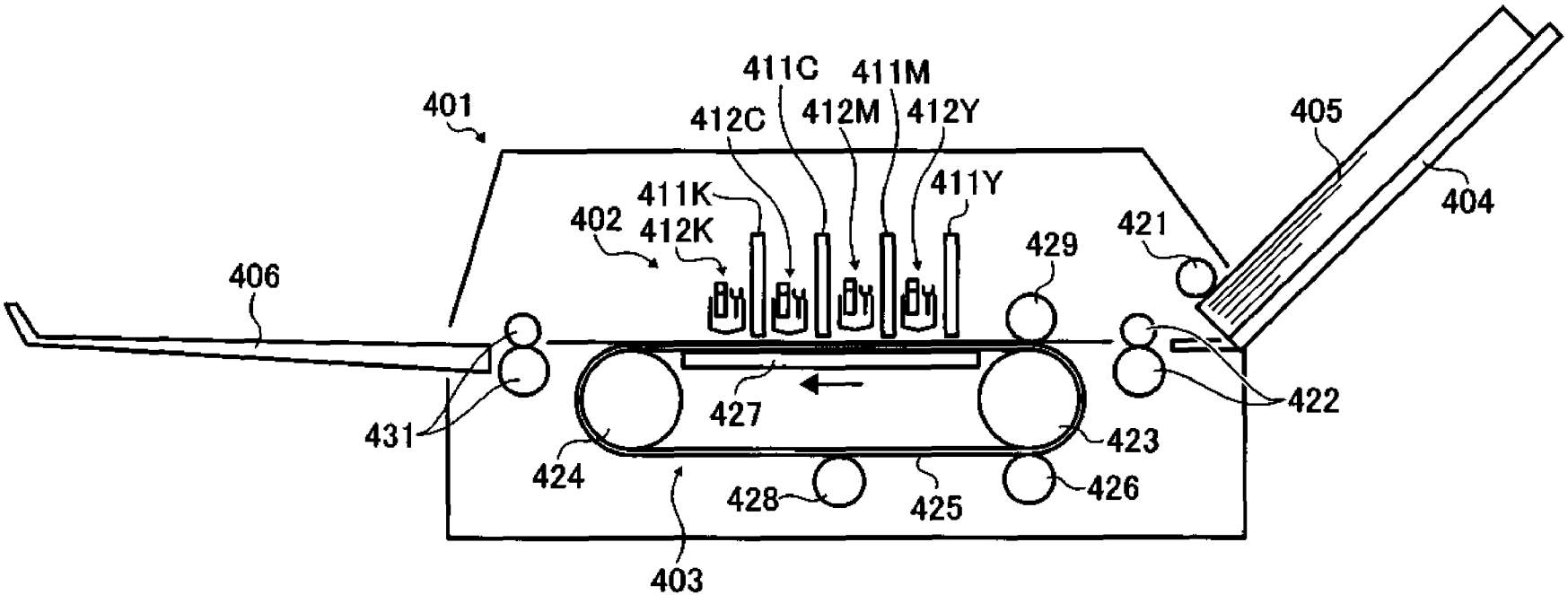
FIG. 1 is a schematic view of an image forming apparatus according to an exemplary embodiment.

In describing, exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 401 according to an exemplary embodiment is explained.

As illustrated in FIG. 1, the image forming apparatus 401 includes a paper tray 404, a feeding roller 421, a sheet supply roller pair 422, an image forming device 402, a conveying mechanism 403, an output roller pair 431, and an output tray 406. The image forming device 402 includes line-type recording heads 411Y, 411M, 411C, and 411K and maintenance-recovery units 412Y, 412M, 412C, and 412K. The conveying mechanism 403 includes a conveying belt 425, a driving roller 423, a driven roller 424, a charging roller 426, a guide 427, a cleaning roller 428, and a sheet pressing roller 429.

The image forming apparatus 401 can be any of a copying machine, a printer, a facsimile machine, a plotter, and a multifunction printer including two or more of copying, printing, scanning, and facsimile functions. In this exemplary embodiment, the image forming apparatus 401 functions as a line-type image forming apparatus for forming an image on a recording medium. The image forming apparatus 401 includes a full-line type recording head.

The paper tray 404 is attached to one side of the image forming apparatus 401, and loads a recording medium (e.g., a plurality of sheets 405), which is not limited to paper. The feeding roller 421 separates an uppermost sheet 405 from the other sheets 405 placed in the paper tray 404 to feed the sheets 405 one by one toward the sheet supply roller pair 422. The sheet supply roller pair 422 feeds the sheet 405 toward the conveying mechanism 403.

The image forming device 402, serving as a liquid discharging device, discharges a liquid drop to form an image on the sheet 405 while the conveying mechanism 403 conveys the sheet 405. In the image forming device 402, liquid tanks (not shown) for containing liquid are integrated with the line-type recording heads 411Y, 411M, 411C, and 411K. Each of the line-type recording heads 411Y, 411M, 411C, and 411K, serving as a liquid discharging head, includes a row of nozzles having a length equivalent to a width of the sheet 405 in a width direction of the sheet 405 (e.g., a direction perpendicular to a sheet conveyance direction). The line-type recording heads 411Y, 411M, 411C, and 411K are attached to a head holder (not shown) in a manner that the line-type recording heads 411Y, 411M, 411C, and 411K may be lifted and lowered.

For example, the line-type recording heads 411Y, 411M, 411C, and 411K are arranged in this order from upstream to downstream in the sheet conveyance direction, and discharge yellow, magenta, cyan, and black liquid drops, respectively. The line-type recording heads 411Y, 411M, 411C, and 411K may be integrated to form a single recording head including a plurality of nozzles for discharging yellow, magenta, cyan, and black liquid drops in which the plurality of nozzles is arranged in a manner that a predetermined distance is provided between the nozzles. The line-type recording heads 411Y, 411M. 411C, and 411K may not be integrated with the liquid tanks or liquid cartridges. According to this exemplary embodiment, a liquid discharging device (e.g., the image forming device 402) includes the line-type recording heads 411Y, 411M, 411C, and 411K and the liquid tanks. However, the liquid discharging device may not include the liquid tanks or may include an element other than the liquid tanks.

The maintenance-recovery units 412Y, 412M, 412C, and 412K correspond to the line-type recording heads 411Y, 411M, 411C, and 411K, respectively. The maintenance-recovery units 412Y, 412M, 412C, and 412K, each serving as a maintenance-recovery mechanism or a maintenance-recovery unit for maintaining and recovering a condition of the liquid discharging head, are movably provided in the sheet conveyance direction. For example, the maintenance-recovery units 412Y, 412M, 412C, and 412K may move to a wiping position to wipe the line-type recording heads 411Y, 411M, 411C, and 411K, a capping position to cap the line-type recording heads 411Y, 411M, 411C, and 411K, and a retreat position to retreat from the line-type recording heads 411Y, 411M, 411C, and 411K while the line-type recording heads 411Y, 411M, 411C; and 411K form an image on the sheet 405, respectively.

The conveying mechanism 403 conveys the sheet 405 sent from the paper tray 404. In the conveying mechanism 403, the conveying belt 425 is looped over the driving roller 423 and the driven roller 424. The charging roller 426 charges the conveying belt 425. The guide 427 (e.g., a platen plate) guides the conveying belt 425 at a position at which the conveying belt 425 opposes the image forming device 402. The cleaning roller 428 includes a porous body and removes liquid (e.g., ink) adhering to the conveying belt 425. the sheet pressing roller 429 presses the sheet 405 onto the conveying belt 425.

The output roller pair 431 is provided downstream from the conveying mechanism 403 in the sheet conveyance direction. The output roller pair 431 feeds the sheet 405 bearing the image onto the output tray 406. The output tray 406 is attached to another side of the image forming apparatus 401, and receives the sheet 405 fed by the output roller pair 431.

In the line-type image forming apparatus 401, the sheet 405 is fed onto the charged conveying belt 425. The conveying belt 425 electrostatically attracts the sheet 405. While the rotating conveying belt 425 conveys the sheet 405, the image forming device 402 forms an image on the sheet 405. The sheet 405 bearing the image is output onto the output tray 406.

Figure 2:
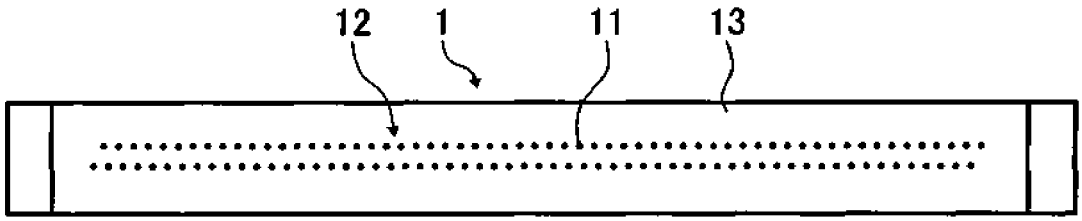
FIG. 2 is a plane view of a liquid discharging head of the image forming apparatus shown in FIG. 1.

FIG. 2 is a plane view of a liquid discharging head 1 according to an exemplary embodiment. The liquid discharging head 1 may be the line-type recording head 411Y, 411M, 411C or 411K included in the image forming apparatus 401 (depicted in FIG. 1). As illustrated in FIG. 2, the liquid discharging head 1 includes nozzles 11, a row of nozzles 12, and a nozzle surface 13. Each of the nozzles 11, serving as a discharge opening, discharges a liquid drop. A plurality of nozzles 11 is arranged on the nozzle surface 13 serving as a discharge opening surface to form a row of nozzles 12 serving as a row of discharge openings. The row of nozzles 12 has a length equivalent to a width of a sheet 405 (depicted in FIG. 1).

Figure 3:
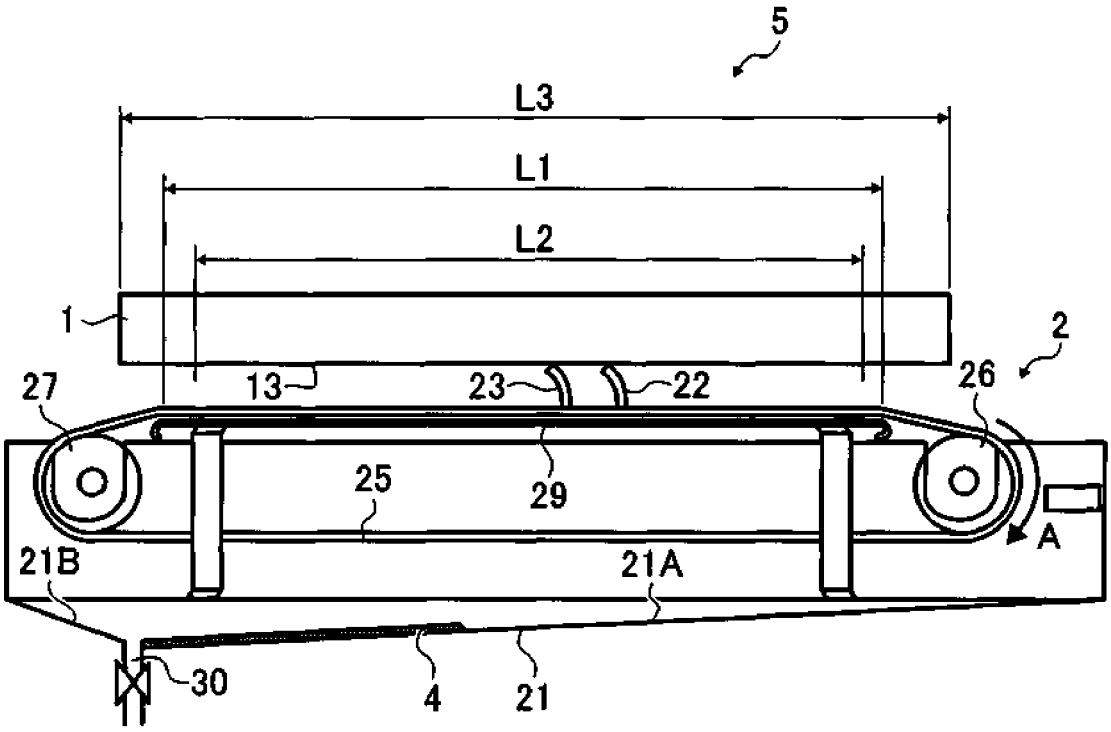
FIG. 3 is a sectional front view of a liquid discharging device of the image forming apparatus shown in FIG. 1.
Figure 4:
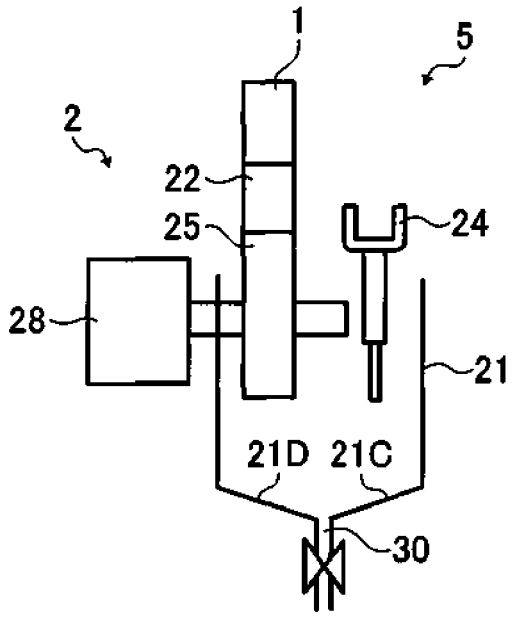
FIG. 4 is a sectional side view of the liquid discharging device shown in FIG. 3.

FIG. 3 is a sectional front view of a liquid discharging device 5 according to an exemplary embodiment. FIG. 4 is a sectional side view of the liquid discharging device 5. The liquid discharging device 5 may be the image forming device 402 (depicted in FIG. 1), and includes the liquid discharging head 1 and a maintenance-recovery unit 2. The maintenance-recovery unit 2 may be the maintenance-recovery-unit 412Y, 412M, 412C, or 412K included in the image forming apparatus 401. The maintenance-recovery unit 2, serving as a maintenance-recovery mechanism or a maintenance-recovery unit, is unitized and maintains and recovers a condition of the liquid discharging head 1.

As illustrated in FIG. 3, the maintenance-recovery unit 2 includes blades 22 and 23, a housing 21, a belt 25, a driving roller 26, a driven roller 27, a pressing member 29, slopes 21A and 21B, and a vent 30. As illustrated in FIG. 4, the maintenance-recovery unit 2 further includes a cap 24, a driving motor 28, and slopes 21C and 21D.

As illustrated in FIG. 3, the two blades 22 and 23 (e.g., wiper blades) are provided in the housing 21 and wipe the nozzle surface 13 of the liquid discharging head 1. As illustrated in FIG. 4, the cap 24 is provided in the housing 21 and caps the nozzle surface 13.

As illustrated in FIG. 3, the belt 25 has an endless belt-like shape and carries the two blades 22 and 23. The belt 25 is looped over the driving roller 26 and the driven roller 27. The driving motor 28 (depicted in FIG. 4), serving as a driver, rotates the driving roller 26. The rotating driving roller 26 rotates the belt 25 in a rotating direction A.

The pressing member 29 is provided on a back surface (i.e., an inner circumferential surface) of the belt 25. The pressing member 29 presses the belt 25 toward the liquid discharging head 1 to move (e.g., lift) a portion of the belt 25 opposing the liquid discharging head 1 toward the liquid discharging head 1 up to a position above a line connecting the driving roller 26 and the driven roller 27. Thus, the pressing member 29 maintains a gap between each of the blades 22 and 23 and the nozzle surface 13 of the liquid discharging head 1 to have a substantially constant size.

The pressing member 29 has a length L1 for which the gap between each of the blades 22 and 23 and the nozzle surface 13 is maintained to have a substantially constant size. The length L1 is not smaller than a length L2 of the row of nozzles 12 (depicted in FIG. 2) and not greater than a length L3 of the liquid discharging head 1.

As illustrated in FIGS. 3 and 4, the slopes 21A, 21B, 21C, and 21D form an inner bottom surface of the housing 21. The vent 30 is provided in a lowermost part of the inner bottom surface. Liquid discharged by the liquid discharging head 1 is sent to a waste liquid tank (not shown) via the vent 30. The slopes 21A, 21B, 21C, and 21D and the vent 30 provided in a bottom of the housing 21 may effectively send a liquid 4 removed from the liquid discharging head 1 by wiping, for example, from the maintenance-recovery unit 2 to the waste liquid tank.

Referring to FIG. 3, the following describes a wiping operation, that is, one of maintenance-recovery operations performed by the maintenance-recovery unit 2 having the above-described structure. For example, the driving motor 28 (depicted in FIG. 4) is driven to rotate the belt 25. The blades 22 and 23 carried by the belt 25 move and thereby contact the nozzle surface 13 of the liquid discharging head 1. The blades 22 and 23 wipe the nozzle surface 13 in accordance with the rotation of the belt 25.

The pressing member 29 contacts the back surface of the belt 25 to lift the belt 25 in an area in which the belt 25 opposes the nozzle surface 13, maintaining flatness of the belt 25. Accordingly, a substantially constant gap may be formed between each of the blades 22 and 23 and the nozzle surface 13. The blades 22 and 23 contact or slidably contact the nozzle surface 13 by applying a substantially constant pressure while moving in a longitudinal direction of the nozzle surface 13. Thus, the blades 22 and 23 may properly wipe the nozzle surface 13.

Figure 5:
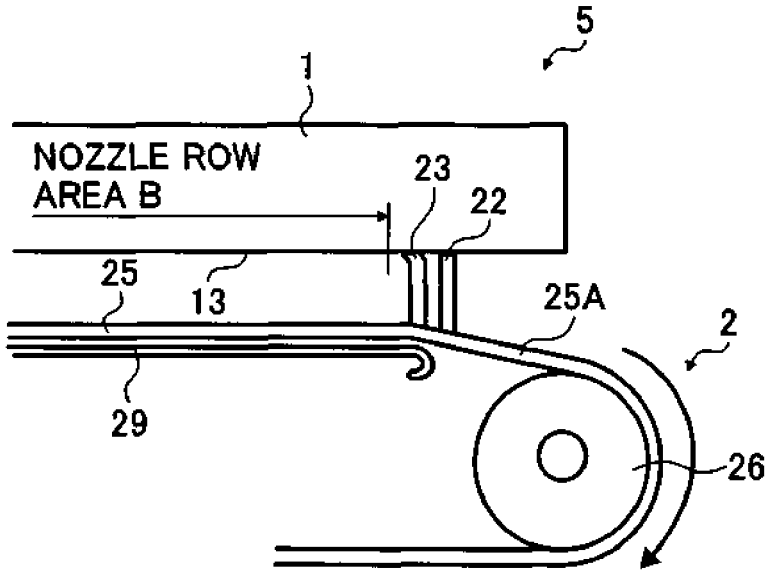
FIG. 5 is an enlarged sectional front view of the liquid discharging device shown in FIG. 3.

FIG. 5 is an enlarged sectional front view of the liquid discharging device 5. As illustrated in FIG. 5, the maintenance-recovery unit 2 further includes an end portion 25A. The end portion 25A is provided in an end of the belt 25 in a longitudinal direction of the belt 25. When the blades 22 and 23 separate from the nozzle surface 13, the length L1 (depicted in FIG. 3) for which the pressing member 29 maintains the gap between each of the blades 22 and 23 and the nozzle surface 13 to have a substantially constant size is not smaller than the length L2 (depicted in FIG. 3) of the row of nozzles 12 (depicted in FIG. 2) and not greater than the length L3

(depicted in FIG. 3) of the liquid discharging head 1. Therefore, the end portion 25A of the belt 25 gradually lowers from an end of the pressing member 29 in a longitudinal direction of the pressing member 29 toward the driving roller 26. Namely, before the blades 22 and 23 reach an end of the liquid discharging head 1 in a longitudinal direction of the liquid discharging head 1 after the blades 22 and 23 pass a nozzle row area B (i.e., an area in which the row of nozzles 12 is provided), the blades 22 and 23 gradually move away from the nozzle surface 13.

As illustrated in FIG. 3, the blades 22 and 23 are bent when the blades 22 and 23 move in an area corresponding to the length L1 in which the pressing member 29 presses the blades 22 and 23 toward the liquid discharging head 1. After the blades 22 and 23 pass the area corresponding to the length L1, the blades 22 and 23 gradually move away from the liquid discharging head 1. Accordingly, the bent blades 22 and 23 are gradually straightened to return to an original shape. As a result, scattering of liquid removed by and adhering to the blades 22 and 23 may be prevented or reduced.

As illustrated in FIG. 3, according to the above-described exemplary embodiment, a maintenance-recovery mechanism (e.g., the maintenance-recovery unit 2) includes a belt;(e.g.:, the belt 25) for carrying blades (e.g., the blades 22 and 23) and being rotatable in a direction corresponding to a row of discharge openings (e.g., the row of nozzles 12 depicted in FIG. 2) of a liquid discharging head (e.g., the liquid discharging head 1). The maintenance-recovery mechanism further includes a pressing member (e.g., the pressing member 29) for pressing a back surface (e.g., an inner circumferential surface) of the belt at apportion of the belt opposing the liquid discharging head so as to maintain a gap between each of the blades and a discharge opening surface (e.g., the nozzle surface 13) of the liquid discharging head to have a substantially constant size. A length for which the pressing member maintains the gap to have the substantially constant size is not smaller than a length of the row of discharge openings and not greater than a length of the liquid discharging head. Even when the liquid discharging head has a long size, the blades may wipe the discharge opening surface by applying a constant pressure. Thus, the blades may provide an improved wiping for cleaning the whole discharge opening surface. As a result, a faulty image (e.g., an image having a white spot) caused by non-discharge of liquid may be prevented. Further, when the blades move away from the discharge opening surface of the liquid discharging head, scattering of liquid adhering to the blades may be prevented or reduced.

Figure 6:
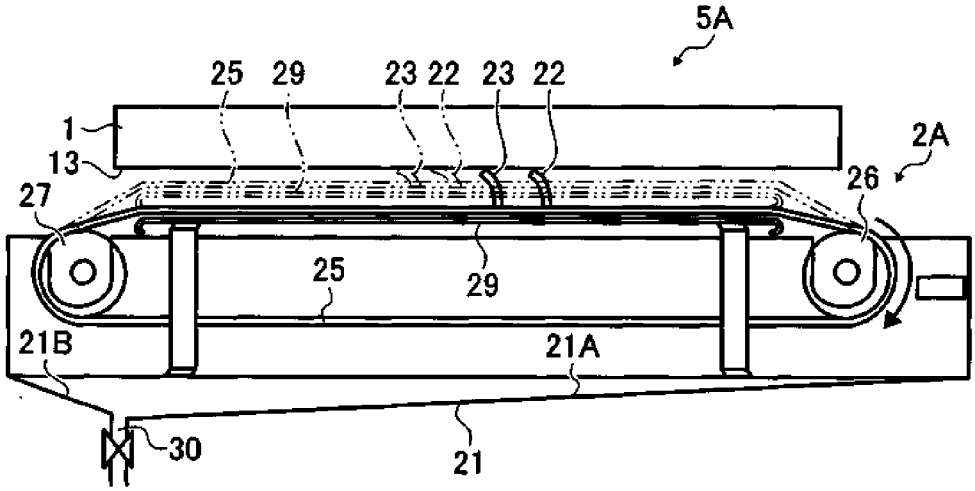
FIG. 6 is a sectional front view of a liquid discharging device according to another exemplary embodiment.

FIG. 6 is a sectional front view of a liquid discharging device 5A according to another exemplary embodiment. The liquid discharging device 5A includes the liquid discharging head 1 and a maintenance-recovery unit 2A. The maintenance-recovery unit 2A includes a lift-lower mechanism for lifting and lowering the pressing member 29 (e.g., a lift-lower mechanism 41 illustrated in FIG. 7). The other elements of the liquid discharging device 5A are common to the liquid discharging device 5 depicted in FIG. 3. The lift-lower mechanism 41 continuously or uncontinuously moves the pressing member 29 from a position illustrated in a solid line to a position illustrated in a broken line to change a distance between the pressing member 29 and the nozzle surface 13. The lift-lower mechanism 41 may be moved manually or automatically. Namely, the lift-lower mechanism 41 serves as an adjuster for changing the distance between the pressing member 29 and nozzle surface 13. For example, the position of the pressing member 29 may be changed in accordance with change of a condition of the nozzles 11 (depicted in FIG. 2) caused by change in temperature and wear which occurs with time. Thus, pressure applied by the blades 22 and 23 to the nozzle surface 13 may be properly adjusted. A structure of the lift-lower mechanism according to this exemplary embodiment is not limited to the structure of the lift-lower mechanism 41.

According to this exemplary embodiment, the position of a pressing member (e.g., the pressing member 29) may be changed to cause a gap between the pressing member and a whole discharge opening surface (e.g., the nozzle surface 13) to have a substantially constant size. Blades (e.g., the blades 22 and 23) may slide on the discharge opening surface while applying a proper pressure adjusted in accordance with the condition of a discharge opening (e.g., the nozzle 11). For examples, when the blades wear and have a worn edge, the position of the pressing member is changed so that the blades are closer to the discharge opening. Thus, the blades may wipe the discharge opening with an increased pressure. Namely, the blades may maintain a proper wiping property.

Figure 7:
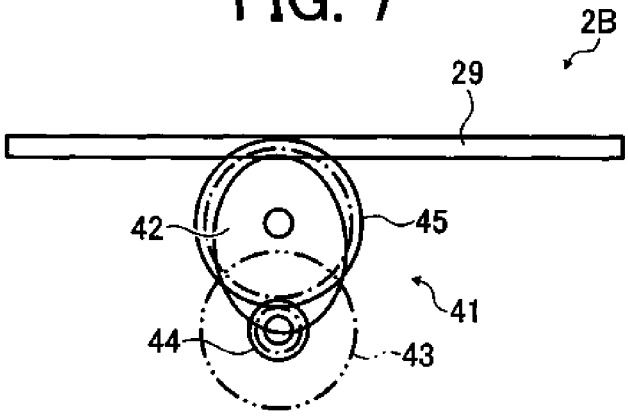
FIG. 7 is a sectional front view of a maintenance-recovery unit of the liquid discharging device shown in FIG. 6 according to yet another exemplary embodiment.
Figure 8:
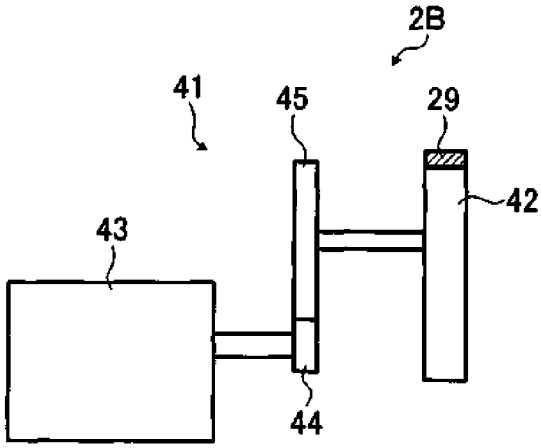
FIG. 8 is a sectional side view of the maintenance-recovery unit shown in FIG. 7.

FIG. 7 is a sectional front view of a maintenance-recovery unit 2B according to yet another exemplary embodiment. FIG. 8 is a sectional side view of the maintenance-recovery unit 2B. The maintenance-recovery unit 2B includes the lift-lower mechanism 41. The lift-lower mechanism 41 includes a cam 42,. a driving motor 43, and gears 44 and 45. The other elements of the maintenance-recovery unit 2B are common to the maintenance-recovery unit 2 depicted in FIG. 3.

The lift-lower mechanism 41 lifts and lowers (e.g., moves up and down) the pressing member 29. The cam 42 opposes the pressing member 29. The driving motor 43 rotates the cam 42 via the gears 44 and 45. Namely, the gears 44 and 45 transmit a driving force generated by the driving motor 43 to the cam 42. Thus, the rotating cam 42 lifts and lowers the pressing member 29. Alternatively, the cam 42 may be rotated via a solenoid and/or a link member.

Figure 9:
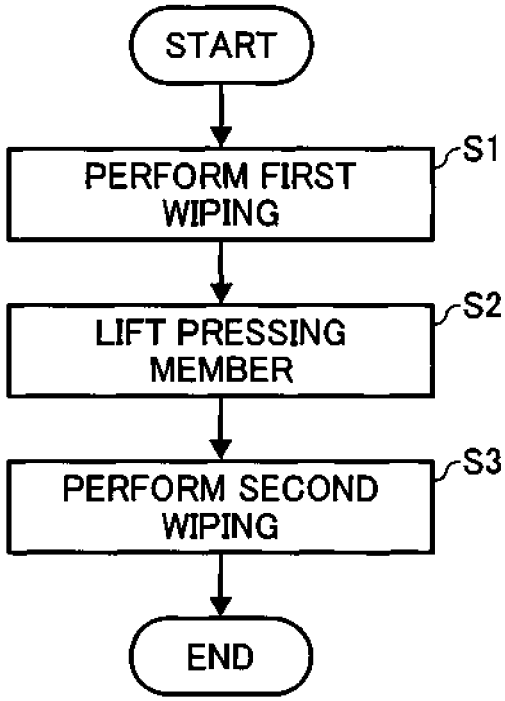
FIG. 9 is a flowchart illustrating operations of the maintenance-recovery unit shown in FIG. 7.

Referring to FIG. 9, the following describes operations of the maintenance-recovery unit 2B (depicted in FIGS. 7 and 8). In step S1, the belt 25 (depicted in FIG. 6) rotates and the blades 22 and 23 (depicted in FIG. 6) provided on the belt 25 perform a first wiping for wiping the nozzle surface 13 (depicted in FIG. 6). In step S2, the lift-lower mechanism 41 (depicted in FIG. 7) lifts the pressing member 29 (depicted in FIG. 7) to cause the distance between the pressing member 29 and the nozzle surface 13 to be shorter. Accordingly, the blades 22 and 23 apply an increased pressure to the nozzle surface 13. In step S3, the belt 25 rotates again and the blades 22 and 23 provided on the belt 25 perform a second wiping for wiping the nozzle surface 13.

According to this exemplary embodiment, the blades 22 and 23 wipe the nozzle surface 13 twice in a direction in which the row of nozzles 12 (depicted in FIG. 2) extends, to remove a substantial amount of liquid adhering to the nozzle surface 13. In the first wiping, the blades 22 and 23 mainly remove the substantial amount of liquid adhering to the nozzle surface 13. In the second wiping, the blades 22 and 23 recover a proper meniscus of liquid in the nozzles 11 (depicted in FIG. 2). The lift-lower mechanism 41 may adjust or change the position of the pressing member 29 so that the blades 22 and 23 apply a proper pressure to the nozzle surface 13 adjusted for each of the first and second wiping.

Figure 10:
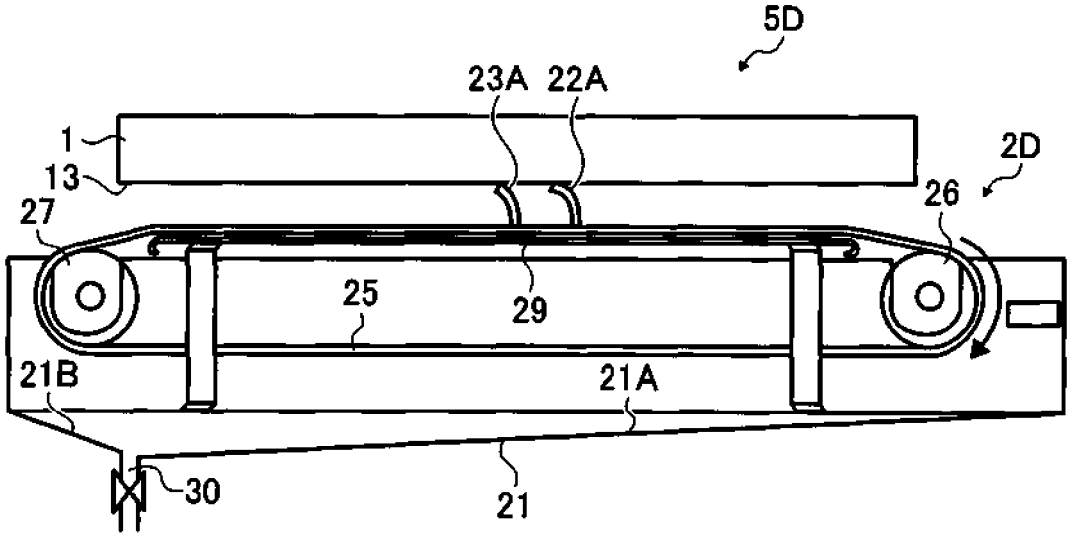
FIG. 10 is a sectional front view of a liquid discharging device according to yet another exemplary embodiment.
Figure 11:
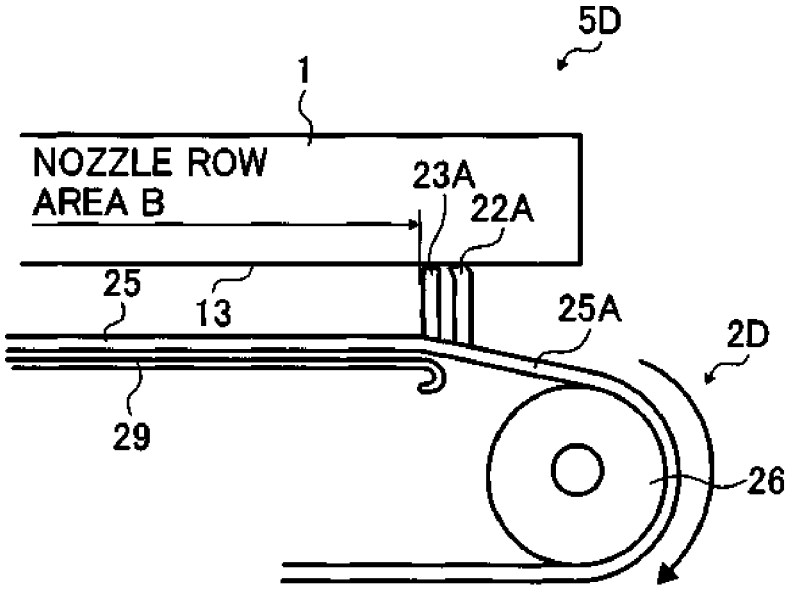
FIG. 11 is an enlarged sectional front view of the liquid discharging device shown in FIG. 10.

FIG. 10 is a sectional front view of a liquid discharging device 5D according to yet another exemplary embodiment. FIG. 11 is an enlarged sectional front view of the liquid discharging device 5D. The liquid discharging device 5D includes the liquid discharging head 1 and a maintenance-recovery unit 2D. The maintenance-recovery unit 2D includes blades 22A and 23A. The other elements of the liquid discharging device 5D are common to the liquid discharging device 5 depicted in FIG. 3.

The blade 22A, serving as a first blade, wipes the nozzle surface 13 before the blade 23A, serving as a second blade, wipes the nozzle surface 13. The blade 22A has a height greater than a height of the blade 23A. The blade 23A has a height at which the blade 23A does not touch an area on the nozzle surface 13 in which the row of nozzles 12 (depicted in FIG. 2) is not provided. Namely, the blade 23A does not touch an area outside the nozzle row area B on the nozzle surface 13 in which the row of nozzles 12 is provided.

With the above-described structure, the blade 22A, which wipes the nozzle surface 13 before the blade 23A wipes the nozzle surface 13, removes a substantial amount of liquid adhering to the nozzle surface 13. The blade 23A, which wipes the nozzle surface 13 after the blade 22A wipes the nozzle surface 13, forms a proper meniscus of liquid in the nozzles 11 (depicted in FIG. 2), or removes residual liquid not removed by the blade 22A. When liquid has a high viscosity (e.g., about 5 mPa/m or higher), the blade 22A may have an increased height to slide on the nozzle surface 13 with an increased pressure, so as to remove a substantial amount of liquid.

Figure 12:
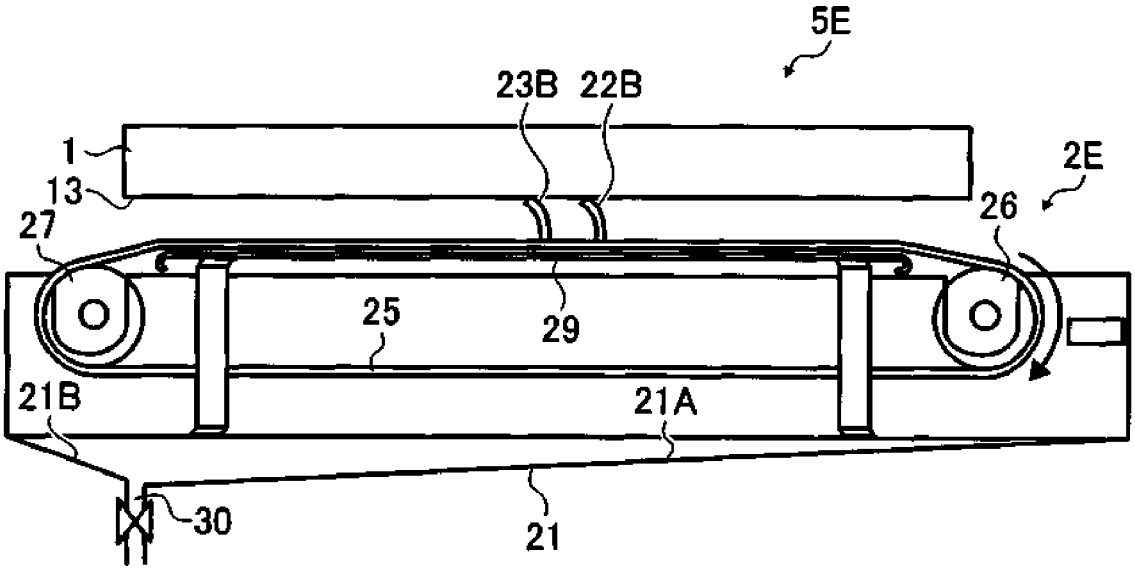
FIG. 12 is a sectional front view of a liquid discharging device according to yet another exemplary embodiment.
Figure 13A:
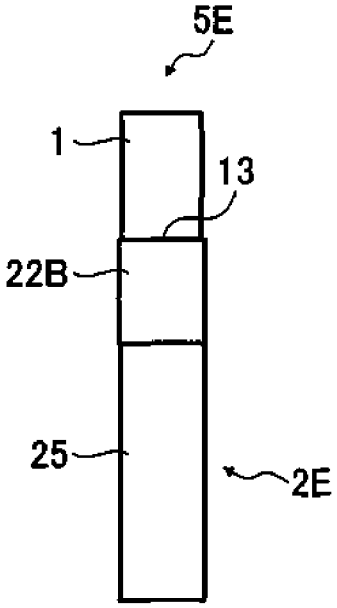
FIGS. 13A and 13B illustrate a sectional side view of the liquid discharging device shown in FIG. 12.
Figure 13B:
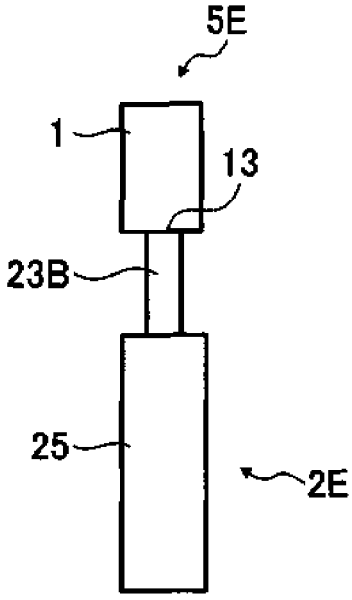

FIG. 12 is a sectional front view of a liquid discharging device 5E according to yet another exemplary embodiment. FIGS. 13A and 13B illustrate a sectional side view of the liquid discharging device SE. The liquid discharging device SE includes the liquid discharging head 1 and a maintenance-recovery unit 2E. The maintenance-recovery unit 2E includes blades 22B and 23B. The other elements of the liquid discharging device 5E are common to the liquid discharging device 5 depicted in FIG. 3.

The blade 22B, serving as a first blade, wipes the nozzle surface 13 before the blade 23B, serving as a second blade, wipes the nozzle surface 13. As illustrated in FIG. 13A, the blade 22B. has a width not smaller than a width of the nozzle surface 13. As illustrated in FIG. 13B, the blade 23B has a width smaller. than the width of the nozzle surface 13. According to this exemplary embodiment, the width of the blade 23B has a size needed to cover the row of nozzles 12 (depicted in FIG. 2) provided on the nozzle surface 13.

With the above-described structure, the blade 22B, which wipes the nozzle surface 13 before the blade 23B wipes the nozzle surface 13, removes a substantial amount of liquid adhering to the nozzle surface 13. The blade 23B, which wipes the nozzle surface 13 after the blade 22B wipes the nozzle surface 13, forms a proper meniscus of liquid in the nozzles 11 (depicted in FIG. 2). While the belt 25 rotates for one rotation, the nozzle surface 13 may be wiped twice, resulting in a shortened wiping time.

Figure 14:
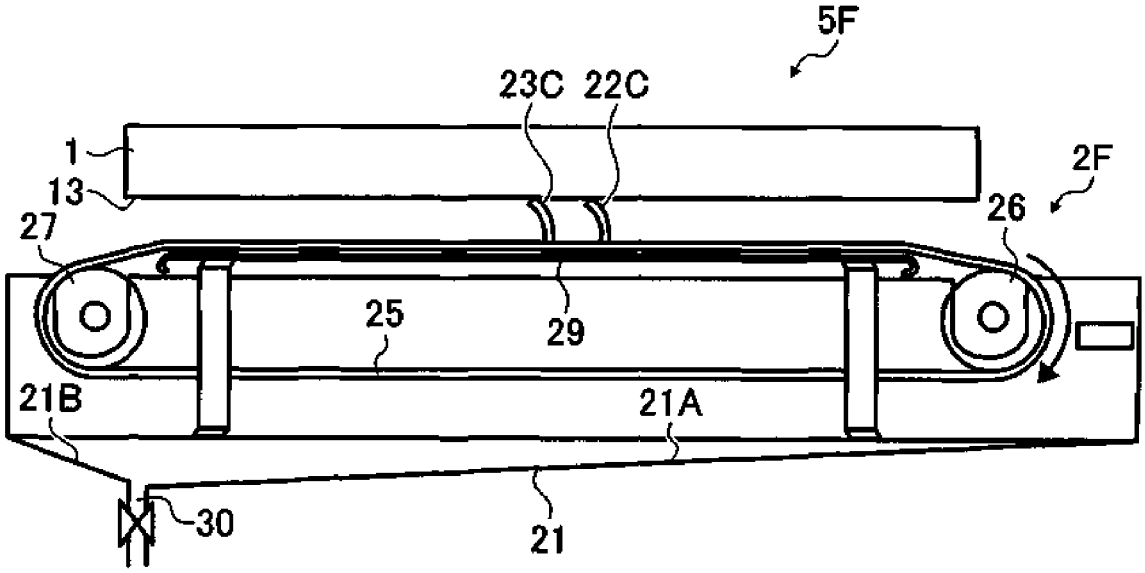
FIG. 14 is a sectional front view of a liquid discharging. device according to yet another exemplary embodiment.

FIG. 14 is a sectional front view of a liquid discharging device 5F according to yet another exemplary embodiment. The liquid discharging device 5F includes the liquid discharging head 1 and a maintenance-recovery unit 2F. The maintenance-recovery unit 2F includes blades 22C and 23C. The other elements of the liquid discharging device 5F are common to the liquid discharging device 5 depicted in FIG. 3.

The blade 22C, serving as a first blade, wipes the nozzle surface 13 before the blade 23C, serving as a second blade, wipes the nozzle surface 13. In one example, the blade 23C applies a pressure greater than a pressure applied by the blade 22C to the nozzle surface 13. In another example, the blade 22C has a. thickness smaller than a thickness of the blade 23C. In yet another example, the blade 23C has a hardness smaller than a hardness of the blade 22C.

With the above-described structure, the blade 22C, which wipes the nozzle surface 13 before the blade 23C wipes the nozzle surface 13, removes a substantial amount of liquid adhering to the nozzle surface 13. The blade 23C, which wipes the nozzle surface 13 after the blade 22C wipes the nozzle surface 13, forms a proper meniscus of liquid in the nozzles 11 (depicted in FIG. 2). While the belt 25 rotates for one rotation, the nozzle surface 13 may be wiped twice, resulting in a shortened wiping time.

Figure 15:
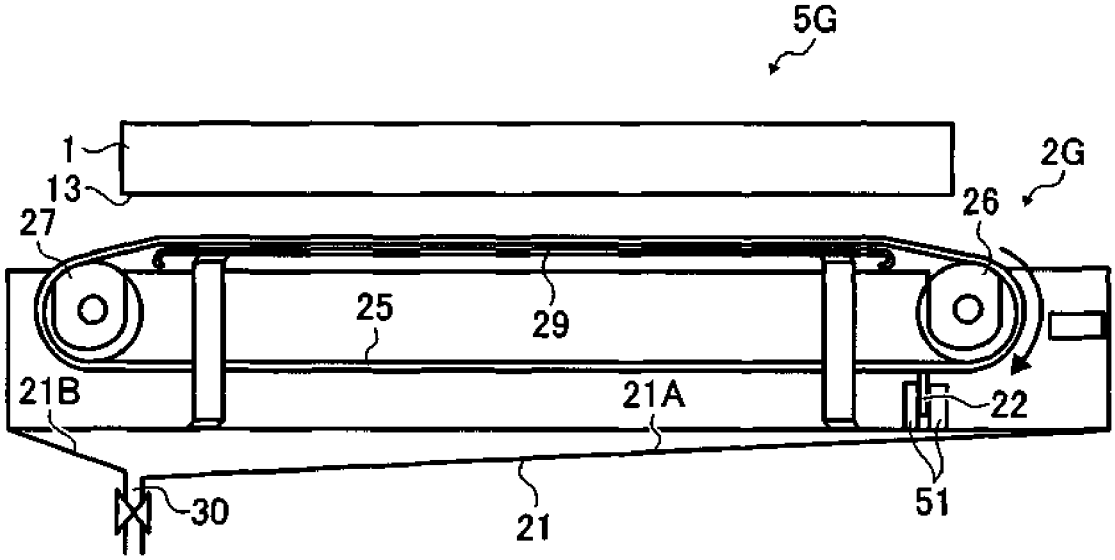
FIG. 15 is a sectional front view of a liquid discharging device according to yet another exemplary embodiment.

FIG. 15 is a sectional front view of a liquid discharging device 5G according to yet another exemplary embodiment. The liquid discharging device 5G includes the liquid discharging head 1 and a maintenance-recovery unit 2G. The maintenance-recovery unit 2G includes a cleaning member 51. The other elements of the liquid discharging device 5G are common to the liquid discharging device 5 depicted in FIG. 3.

The cleaning member 51 is. provided at a position on the slope 21A of the housing 21 near the driving roller 26. Specifically, the cleaning member 51 is provided near a position at which the blade 22 carried by the rotating belt 25, after wiping the nozzle surface 13 and rotating around the driving roller 26, opposes the slope 21A. The cleaning member 51, including an absorbent, absorbs liquid adhering to the blade 22 to clean the blade 22. Namely, the cleaning member 51 serves as a cleaner for removing liquid adhering to the blade 22. When the blade 22 finishes wiping the nozzle surface 13, the belt 25 stops rotating in a state in which the blade 22 contacts the cleaning member 51.

When the blade 22 finishes wiping the nozzle surface 13, liquid removed from the nozzle surface 13 is adhered to the blade 22. However, when the blade 22 stops in a state in which the blade 22 contacts the cleaning member 51, the cleaning member 51 removes the liquid adhering to the blade 22. When a next wiping operation starts, the clean blade 22 may wipe the nozzle surface 13. Thus, the nozzle surface 13 may be continuously cleaned.

Figure 16:
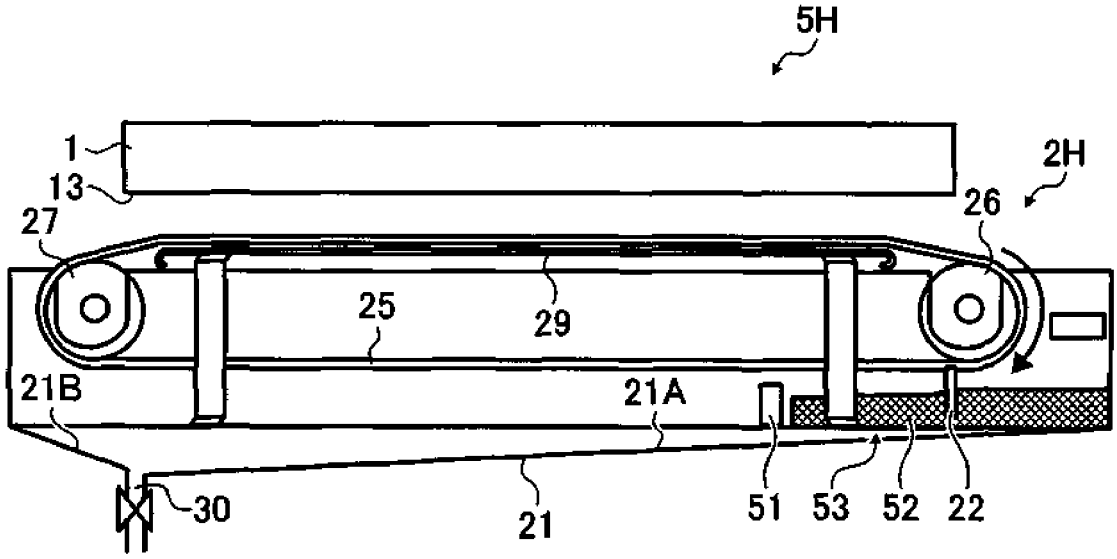
FIG. 16 is a sectional front view of a liquid discharging device according to yet another exemplary embodiment.

FIG. 16 is a sectional front view of a liquid discharging device 5H according to yet another exemplary embodiment. The liquid discharging device 5H includes the liquid discharging head 1 and a maintenance-recovery unit 2H. The maintenance-recovery unit 2H includes a cleaning liquid 52 and a cleaning liquid container 53. The other elements of the liquid discharging device 5H are common to the liquid discharging device 5 depicted in FIG. 3.

The cleaning liquid 52 serves as a cleaner for removing liquid adhering to the blade 22 by dissolution, for example. The cleaning liquid container 53 contains the cleaning liquid 52. The cleaning liquid container 53 is provided at a position on the slope 21A of the housing 21 near the driving roller 26. Specifically, the cleaning liquid container 53 is provided near a position at which the blade 22 carried by the rotating belt 25, after wiping the nozzle surface 13 and rotating around the driving roller 26, opposes the slope 21A. When the blade 22 finishes wiping the nozzle surface 13, the belt 25 stops rotating in a state in which the blade 22 contacts the cleaning liquid 52 (e.g., in a state in which at least a head of the blade 22 is immersed in the cleaning liquid 52). The cleaning liquid 52 may be replaced with new one and thereby may continuously clean the blade 22.

When the blade 22 finishes wiping the nozzle surface 13, liquid removed from the nozzle surface 13 is adhered to the blade 22. However, when the blade 22 stops in a state in which the blade 22 contacts the cleaning liquid 52, the cleaning liquid 52 removes the liquid adhering to the blade 22. When a next wiping operation starts, the clean blade 22 may wipe the nozzle surface 13. Thus, the nozzle surface 13 may be continuously cleaned.

Figure 17:
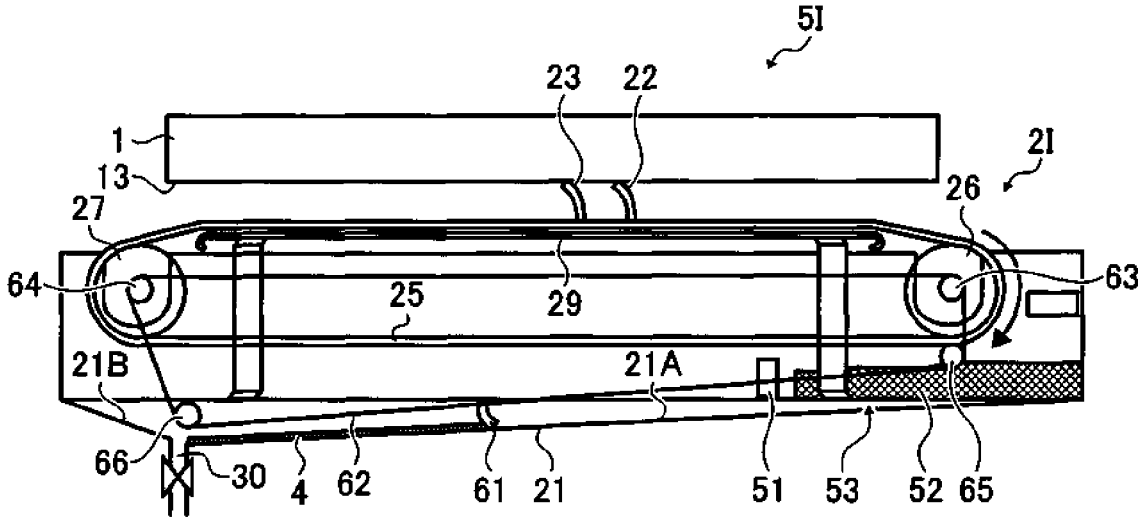
FIG. 17 is a sectional front view of a liquid discharging ,device according to yet another exemplary embodiment.

FIG. 17 is a sectional front view of a liquid discharging device 5I according to yet another exemplary embodiment.

Figure 18:
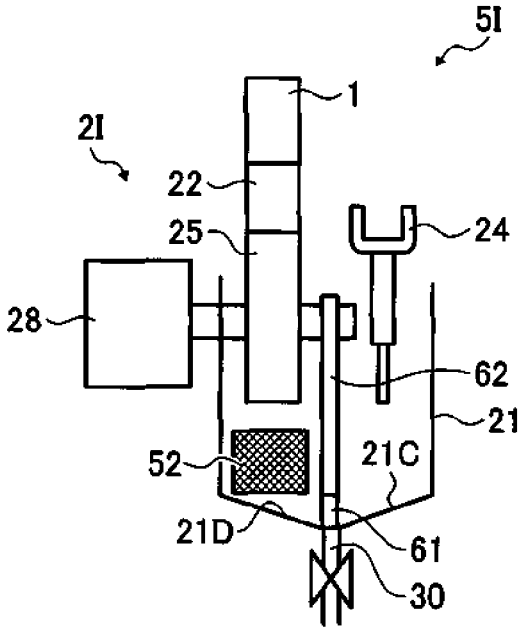
FIG. 18 is a sectional side view of the liquid discharging device shown in FIG. 17.

FIG. 18 is a sectional side view of the liquid discharging device 5I. The liquid discharging device 5I includes the liquid discharging head 1 and a maintenance-recovery unit 2I. The maintenance-recovery unit 21 includes a housing cleaner 61, a belt 62, a driving roller 63, a driven roller 64, and guide rollers 65 and 66. The other elements of the liquid discharging device 5I are common to the liquid discharging device 5H depicted in FIG. 16.

The housing cleaner 61 contacts the slope 21A of the housing 21 and moves toward the vent 30 to clean the bottom of the housing 21. The housing cleaner 61 is attached to the belt 62 having an endless belt-like shape. The belt 62 serves as a housing cleaner belt for carrying the housing cleaner 61, and rotates to move the housing cleaner 61 toward the vent 30. The belt 62 is looped over the driving roller 63, the driven roller 64, and the guide rollers 65 and 66. The driving roller 63 and the driven roller 64 are coaxial with the driving roller 26 and the driven roller 27, respectively, and are driven by the driving motor 28 (depicted in FIG. 18). The guide rollers 65 and 66 guide the belt 62 along the slope 21A. The belt 62 rotates in accordance with the rotating belt 25. The common driving motor 28, serving as a driver, drives and rotates the belts 25 and 62, resulting in a simple, compact structure of the maintenance-recovery unit 2I.

With the above-described structure, after the blades 22 and 23 wipe the nozzle surface 13, the housing cleaner 61 may push liquid 4 removed by the blades 22 and 23 on the slope 21A toward the vent 30. Thus, the liquid 4 may be effectively discharged from the maintenance-recovery unit 2I.

Figure 19A:
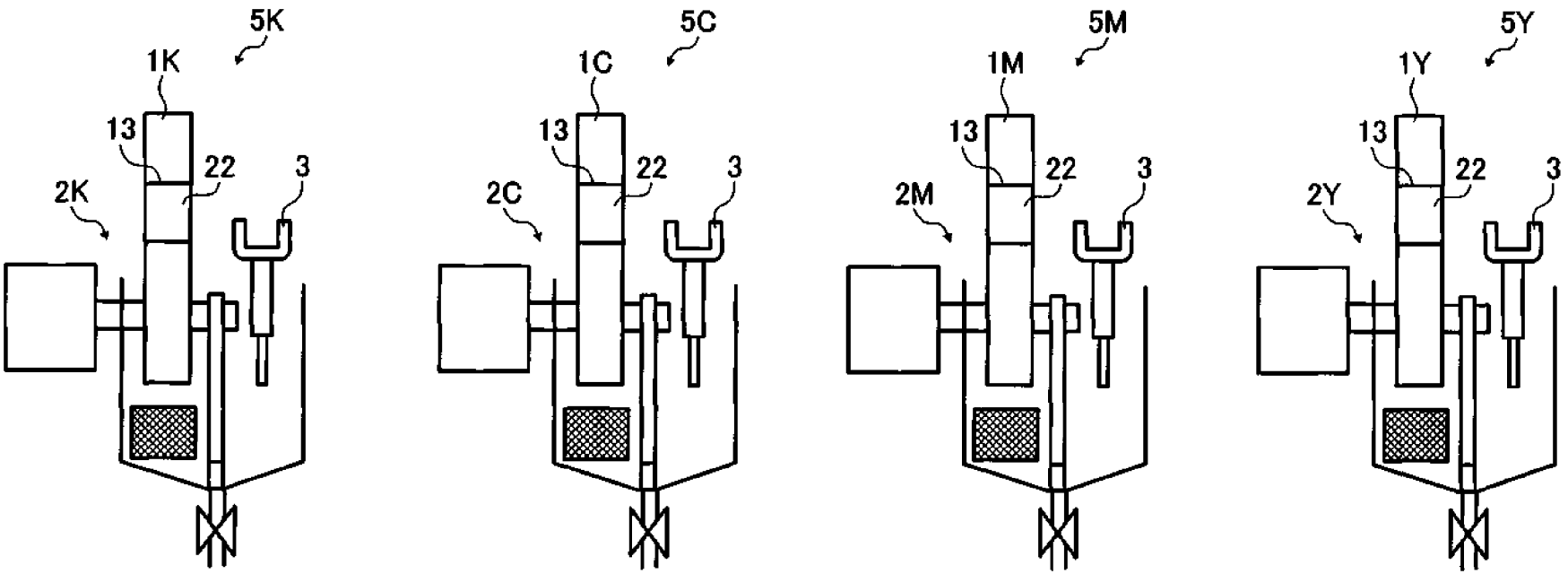
FIGS. 19A, 19B, and 19C illustrate a sectional side view of liquid discharging devices according to yet another exemplary embodiment.
Figure 19B:
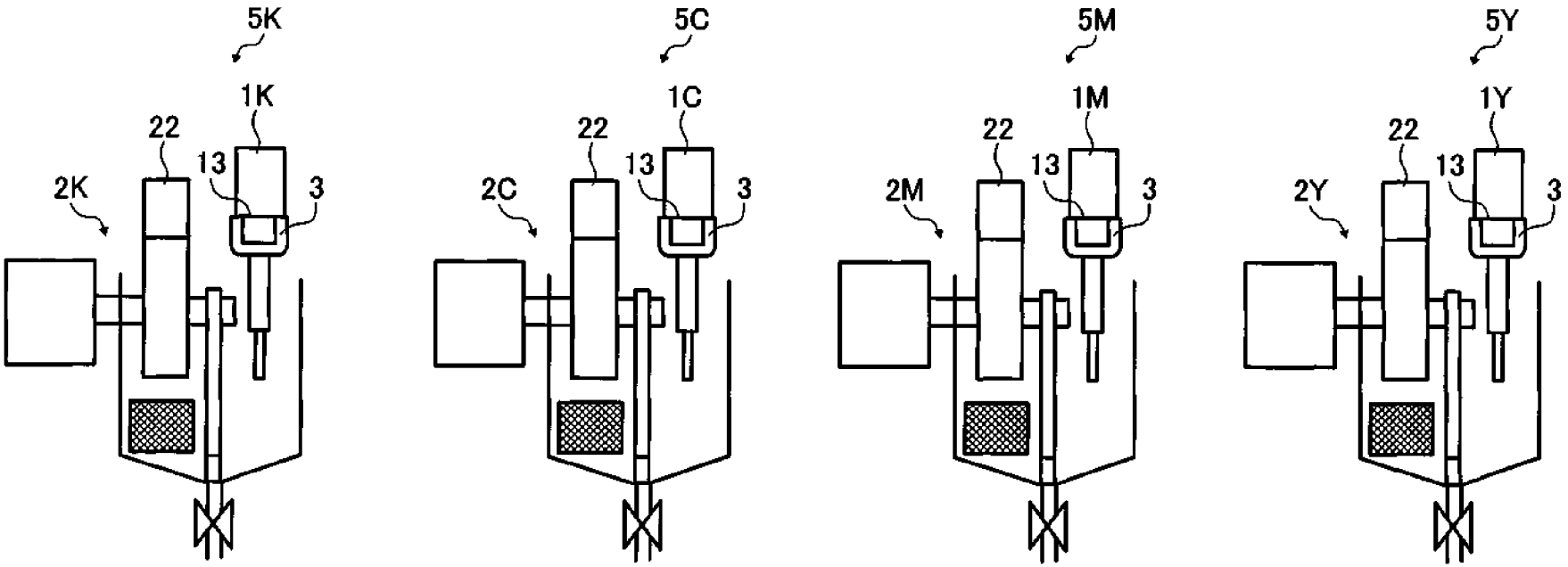
Figure 19C:
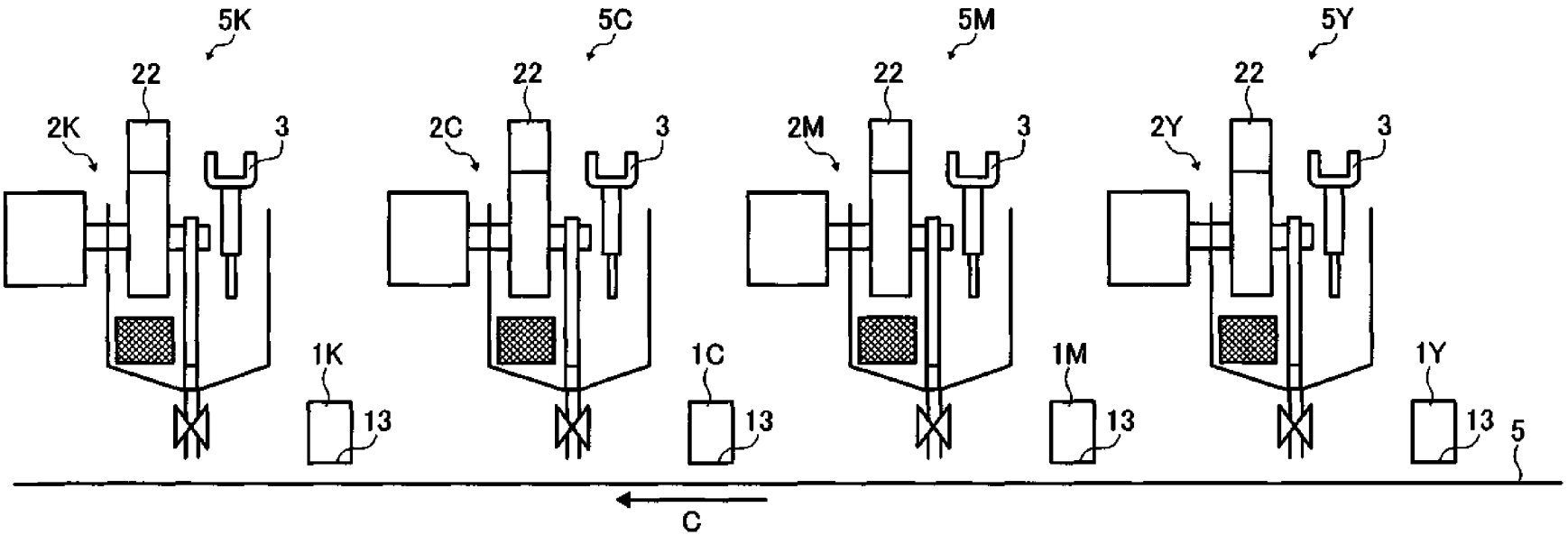

FIGS. 19A, 19B, and 19C illustrate a sectional side view of liquid discharging devices 5K, 5C, 5M, and 5Y according to yet another exemplary embodiment. The liquid discharging devices 5K, 5C, 5M, and 5Y include liquid discharging heads 1K, 1C, 1M, and 1Y and maintenance-recovery units 2K, 2C, 2M, and 2Y, respectively. Each of the maintenance-recovery units 2K, 2C, 2M, and 2Y includes the blade 22 and a cap 3. The other elements of the liquid discharging devices 5K, 5C, 5M, and 5Y are common to the liquid discharging device 5 depicted in FIG. 3.

The liquid discharging heads 1K, 1C, 1M, and 1Y (e.g., line-type liquid discharging heads) discharge black, cyan, magenta, and yellow liquid drops, respectively. The maintenance-recovery units 2K, 2C, 2M, and 2Y correspond to the liquid discharging heads 1K, 1C, 1M, and 1Y, respectively.

FIG. 19A illustrates the liquid discharging devices 5K, 5C, 5M, and 5Y during a wiping operation. The nozzle surface 13 of each of the liquid discharging heads 1K, 1C, 1M, and 1Y opposes the belt 25 (depicted in FIG. 3) of each of the maintenance-recovery units 2K, 2C, 2M, and 2Y. When the belt 25 rotates, the blades 22 and 23 (depicted in FIG. 3) wipe the nozzle surface 13.

FIG. 19B illustrates the liquid discharging devices 5K, 5C, 5M, and 5Y during a capping operation. When the liquid discharging devices 5K, 5C, 5M, and 5Y are in a standby mode, the liquid discharging heads 1K, 1C, 1M, and 1Y move relative to the maintenance-recovery units 2K, 2C, 2M, and 2Y, respectively. Accordingly, the cap 3 of each of the maintenance-recovery units 2K, 2C, 2M, and 2Y caps the nozzle surface 13 of each of the liquid discharging heads 1K, 1C, 1M, and 1Y.

FIG. 19C illustrates the liquid discharging devices 5K, 5C, 5M, and 5Y during a printing operation. When the liquid discharging devices 5K, 5C, 5M, and 5Y perform a printing operation, the liquid discharging heads 1K, 1C, 1M, and 1Y move relative to the maintenance-recovery units 2K, 2C, 2M, and 2Y, respectively. Accordingly, the nozzle surface 13 of each of the liquid discharging heads 1K, 1C, 1M, and 1Y lowers down to a position opposing a sheet 5 conveyed. The nozzles 11 (depicted in FIG. 2) discharge liquid drops at a predetermine time to form an image on the sheet 5 conveyed in a direction C.

Figure 20:
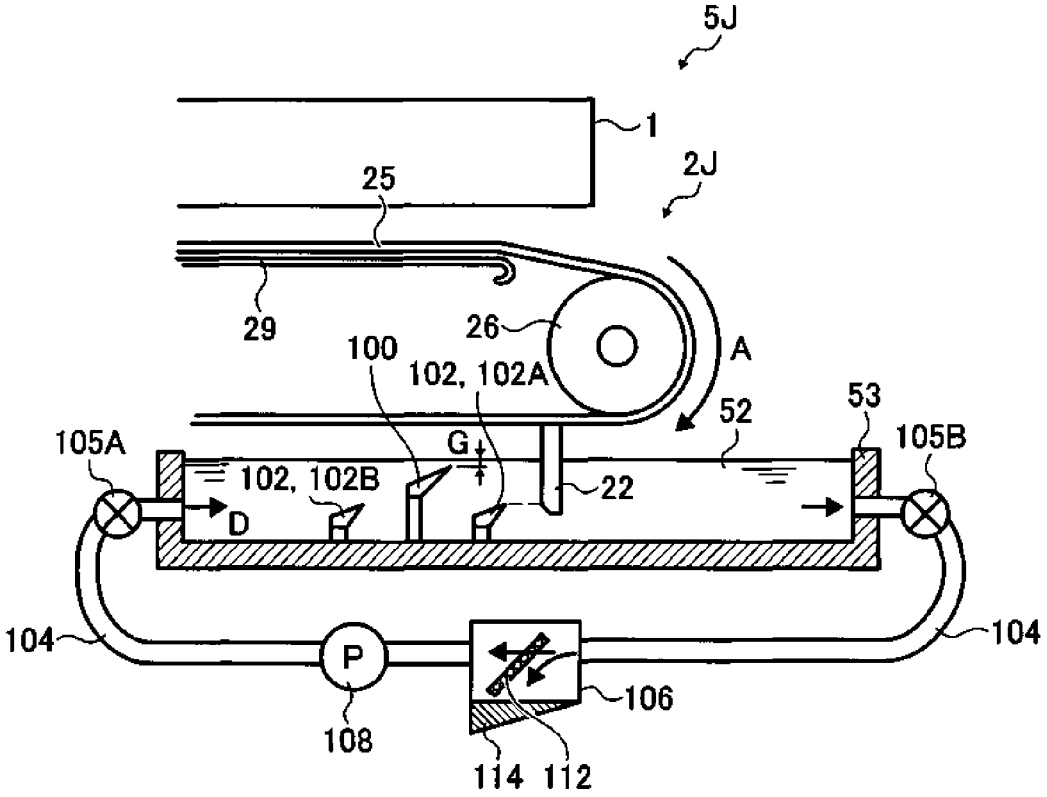
FIG. 20 is a sectional front view of a liquid discharging device according to yet another exemplary embodiment.
Figure 21:
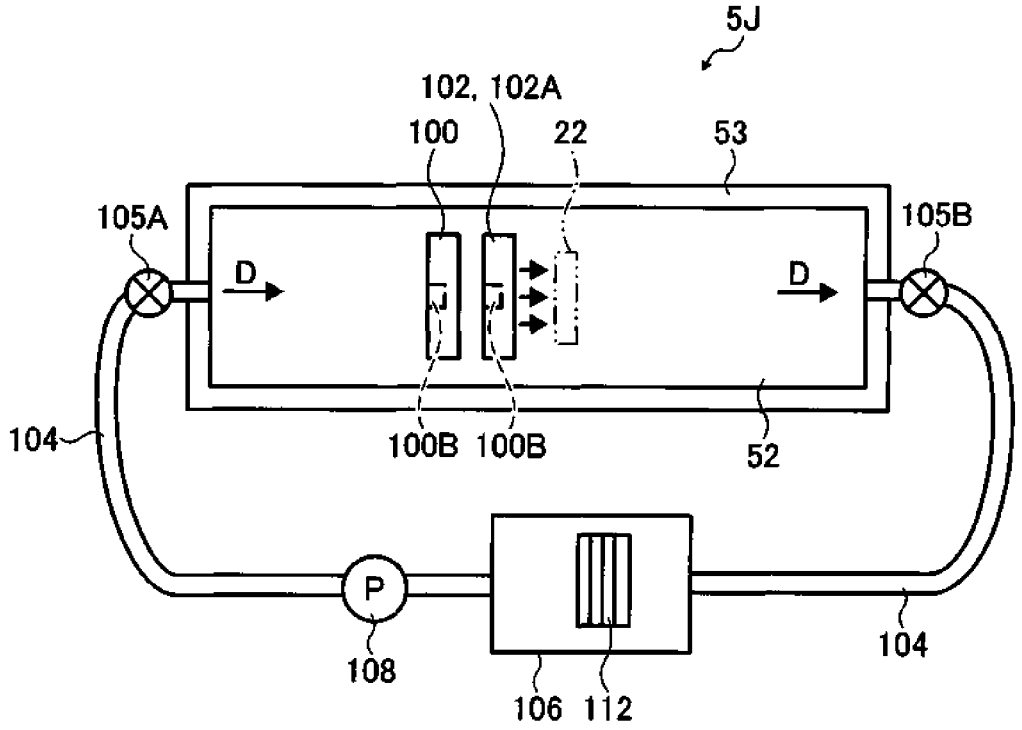
FIG. 21 is a plane view of the liquid discharging device shown in FIG. 20.

Referring to FIGS. 20 to 23, the following describes a liquid discharging device 5J according to yet another exemplary embodiment. FIG. 20 is a sectional front view of the liquid discharging device 5J. FIG. 21 is a plane view of the liquid discharging device 5J.

The liquid discharging device 5J includes the liquid discharging head 1 and a maintenance-recovery unit 2J. The maintenance-recovery unit 2J includes cleaning blades 100 and 102, tubes 104, a tank 106, open-close valves 105A and 105B, and a pump 108. The cleaning blade 102 includes cleaning blades 102A and/or 102B. The tank 106 includes a filter 112 and a waste liquid container 114. The other elements of the liquid discharging device 5J are common to the liquid discharging device 5H depicted in FIG. 16.

The cleaning blade 102 includes at least one of the cleaning blades 102A and 102B. FIG. 21 illustrates the cleaning blade 102A, and does not illustrate the cleaning blade 102B.

Figure 22A:
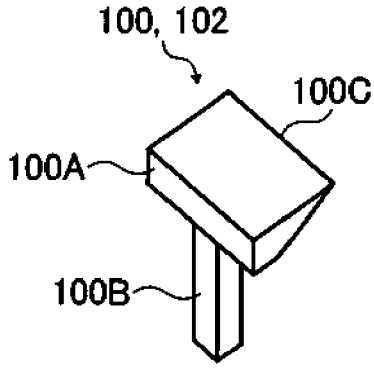
FIG. 22A is a perspective view of a cleaning blade of the liquid discharging device shown in FIG. 20.
Figure 22B:
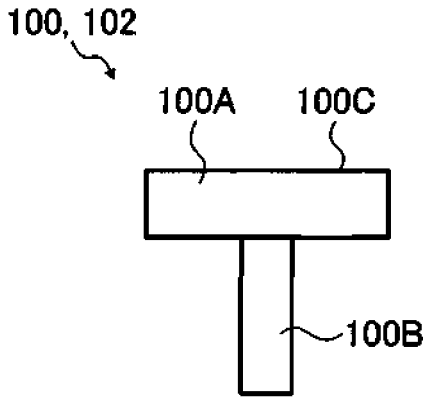
FIG. 22B is a side view of the cleaning blade shown in FIG. 22A.
Figure 22C:
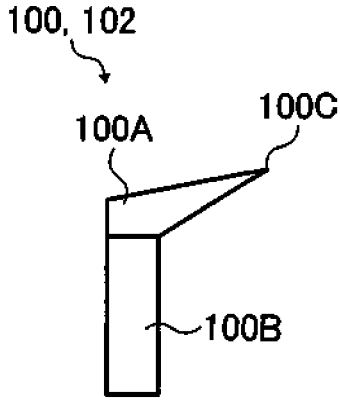
FIG. 22C is a front view of the cleaning blade shown in FIG. 22A.
Figure 22D:
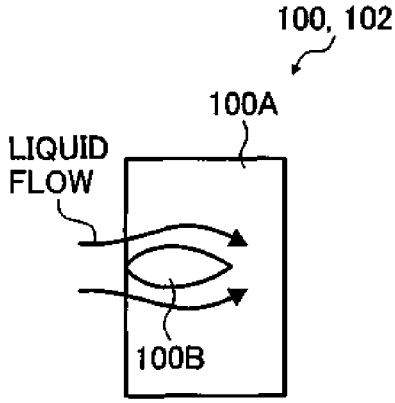
FIG. 22D illustrates an example shape of the cleaning blade shown in FIG. 22A.
Figure 22E:
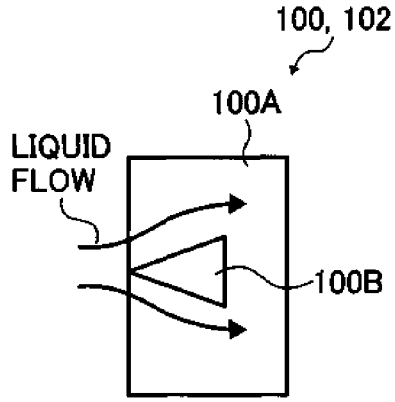
FIG. 22E illustrates another example shape of the cleaning blade shown in FIG. 22A.
Figure 23:
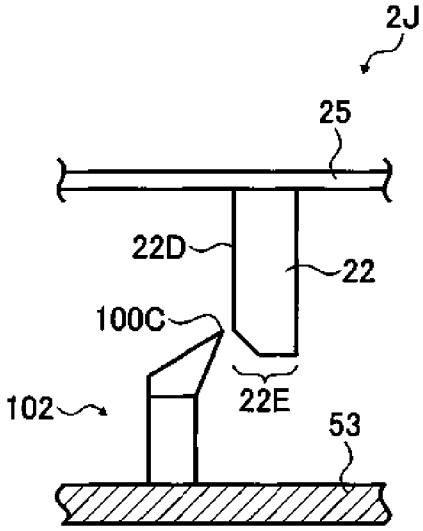
FIG. 23 is an enlarged sectional front view of a maintenance-recovery unit of the liquid discharging device shown in FIG. 20.

FIG. 22A is a perspective view of the cleaning blade 100 or 102. FIG. 22B is a side view of the cleaning blade 100 or 102. FIG. 22C is a front view of the cleaning blade 100 or 102. FIGS. 22D and 22E illustrate a bottom view of the cleaning blade 100 or 102. FIG. 23 is an enlarged sectional front view of the maintenance-recovery unit 2J. As illustrated in FIG. 22A, the cleaning blade 100 or 102 includes a blade 100A and a fix portion 100B. The blade 100A includes a blade edge 100C. As illustrated in FIG. 23, the blade 22 includes a side surface 22D and a bottom surface 22E.

As illustrated in FIG. 20, the cleaning blades 100 and 102 are provided in the cleaning liquid container 53, and clean the blade 22. A height of a head of the blade edge 100C (depicted in FIG. 23) of each of the cleaning, blades 100 and 102 is lower than a height of the cleaning liquid 52. Namely, the head of each of the cleaning blades 100 and 102 is positioned under a liquid level of the cleaning liquid 52. Thus, the entire cleaning blades 100 and 102 are in the cleaning liquid 52. For example, a gap G is provided between the head of the cleaning blade 100 and the liquid level of the cleaning liquid 52. The height of the blade edge 100C of the cleaning blade 100 is higher than the height of the blade edge 100C of the cleaning blade 102.

The cleaning blade 100, serving as a first cleaning blade, contacts the side surface 22D (depicted in FIG. 23) of the blade 22 to remove liquid (e.g., recording liquid) adhering to the side surface 22D. The cleaning blade 102, serving as a second cleaning blade, removes recording liquid adhering to or near the bottom surface 22E (depicted in FIG. 23) of the blade 22. The bottom surface 22E is provided on a bottom head of the blade 22 and includes a slant surface.

One ends of the tubes 104 are connected to downstream and upstream ends of the cleaning liquid container 53 in the rotating direction A of the belt 25, respectively, to flow the cleaning liquid 52 in the cleaning liquid container 53. Another ends of the tubes 104 are connected to the tank 106. The open-close valves 105A and 105B are provided between the tank 106 and the downstream and upstream ends of the cleaning liquid container 53, respectively. The pump l08 is provided between the tank 106 and the downstream end of the cleaning liquid container 53, and supplies the cleaning liquid 52 in a direction D opposite to the rotating direction A of the belt 25.

The filter 112 is provided in the tank 106 in a manner that a lower end of the filter 112 near a downstream end of the tank 106 is slanted down in a liquid flow direction. The recording liquid removed from the blade 22 and contained in the cleaning liquid 52 is output from the cleaning liquid container 53, and is contacted and led by the filter 112 toward the waste liquid container 114. Namely, flow of the cleaning liquid 52 generated by the pump 108 removes re cording liquid adhering to the cleaning blades 100 and 102 and the blade 22 from the cleaning blades 100 and 102 and the blade 22, and conveys the removed recording liquid to the tank 106. When the open-close valves 105A and 105B are closed, the tank 106 and/or the tubes 104 may be removed from the maintenance-recovery unit 2J. Thus, when the waste liquid container 114 is full of waste liquid, the waste liquid container 114 or the filter 112 may be easily removed from the maintenance-recovery unit 2J for replacement, for example.

The pump 108 flows the cleaning liquid 52 in the direction D opposite to a moving direction of the blade 22 driven by the belt 25 rotating in the rotating direction A. Therefore, the blade 22 moves against the flow of the cleaning liquid 52, and thereby may effectively remove recording liquid adhering to the blade 22.

The cleaning blade 102 (i.e., the cleaning blade 102A) may be provided downstream from the cleaning blade 100 in the direction D in which the cleaning liquid 52 flows. Alternatively, the cleaning blade 102 (i.e., the cleaning blade 102B) may be provided upstream from the cleaning blade 100 in the direction D. When the cleaning blade 102, illustrated as the cleaning blade 102B, is provided upstream from the cleaning blade 100 in the direction D, the cleaning blade 102B may remove recording liquid remaining on the bottom head (e.g., the bottom surface 22E depicted in FIG. 23) of the blade 22, after the cleaning blade 100 cleans the side surface 22D (depicted in FIG. 23) of the blade 22 and separates from the blade 22. When the cleaning blade 102, illustrated as the cleaning blade 102A, is provided downstream from the cleaning blade 100 in the direction D, the cleaning blade 100 may clean the side surface 22D of the blade 22, after the cleaning blade 102A removes recording liquid adhering to the bottom head (e.g., the bottom surface 22E depicted in FIG. 23) of the blade 22.

Referring to FIGS. 22A to 22E, the following describes the cleaning blades 100 and 102. As illustrated in FIG. 22A, the blade edge 100C contacts the blade 22 (depicted in FIG. 20) and removes recording liquid adhering to the blade 22 from the blade 22. The fix portion 100B fixes the blade 100A to an inner bottom of the cleaning liquid container 53 (depicted in FIG. 20). As illustrated in FIG. 22B, the fix portion 100B has a width smaller than a width of the blade 100A, so as not to block flow of the cleaning liquid 52 (depicted in FIG. 20). As illustrated in FIG. 22D, the fix portion 100B may preferably have a streamline shape so as not to block flow of the cleaning liquid 52. Alternatively, the fix portion 100B may include a pointed upstream end in a cleaning liquid flow direction, as illustrated in FIG. 22E. As illustrated in FIG. 22C, a head of the blade edge 100C is slanted upward with respect to the blade 22. Thus, the blade edge 100C guides recording liquid removed from the blade 22 downward to prevent the recording liquid from flowing upward on the blade edge 100C The blade 100A has a thickness in a height direction of the blade 100A smaller than a thickness of the fix portion 100B, so as not to block flow of the cleaning liquid 52.

As illustrated in FIG. 20, the cleaning liquid 52, the cleaning liquid container 53, and the cleaning blades 100 and 102 serve as a cleaner for removing recording liquid adhering to the blade 22. For example, the cleaning blades 100 and 102 remove recording liquid adhering to the blade 22 from the blade 22. The pump 108 pumps the removed recording liquid to the tank 106 and the removed recording liquid is precipitated in the waste liquid container 114 of the tank 106. Further, the pump 108 pumps recording liquid adhering to the cleaning blades 100 and 102 to the tank 106 and the recording liquid is precipitated in the waste liquid container 114 of the tank 106. Recording liquid removed from the blade 22 in the cleaning liquid container 53 is flown to the tank 106. Therefore, the clean, cleaning blades 100 and 102, to which recording liquid is not adhered, may clean the blade 22. As a result, recording liquid adhering to the blade 22 may be properly removed from the blade 22.

As illustrated in FIG. 3, in an image forming apparatus (e.g., the image forming apparatus 401 depicted in FIG. 1) or a liquid discharging device (e.g., the liquid discharging device 5) according to the above-described exemplary embodiments, a maintenance-recovery mechanism (e.g., the maintenance-recovery unit 2) includes a belt (e.g., the belt 25) and a pressing member (e.g., the pressing member 29). The belt carries blades (e.g., the blades 22 and 23) and is rotatable in a direction in which a row of discharge openings (e.g., the row of nozzles 12 depicted in FIG. 2) of a liquid discharging head (e.g., the liquid discharging head 1) extends. The pressing member presses a back surface (e.g., an inner circumferential surface) of the belt to lift a portion of the belt opposing the liquid discharging head. Thus, a gap between each of the blades and a discharge opening surface (e.g., the nozzle surface 13) of the liquid discharging head is maintained to have a substantially constant size. A length of the pressing member for which the gap between each of the blades and the discharge opening surface is maintained to have the substantially constant size is not smaller than a length of the row of discharge openings and not greater than a length of the liquid discharging head. Even when the liquid discharging head has a long size, the blades may wipe the discharge opening surface of the liquid discharging head with a constant pressure, providing an increased wiping property. Further, when the blades move away from the discharge opening surface of the liquid discharging head, scattering of liquid adhering to the blades may be prevented or reduced.

As illustrated in FIG. 1, a line-type image forming apparatus (e.g., the image forming apparatus 401) includes the liquid discharging device (e.g., the image forming device 402) according to the above-described exemplary embodiments, resulting in stable formation of a high-quality image at an increased speed.

The image forming apparatus according to the above-described exemplary embodiments may be applied to or may include an image forming apparatus having one of copying, printing, and facsimile functions and an image forming apparatus (e.g., a multi-function printer) having two or more of copying, printing, scanning, and facsimile functions. The above-described exemplary embodiments may be applied to an image forming apparatus using recording liquid other than ink, fixing liquid, and/or the like and to a liquid discharging device for discharging various liquids.

According to the above-described exemplary embodiments, the image forming apparatus includes an apparatus for forming an image by discharging liquid. A recording medium, on which the image forming apparatus forms an image, includes paper, strings, fiber, cloth, leather, metal, plastic, glass, wood, and ceramics. An image formed by the image forming apparatus includes a character, a letter, graphics, and a pattern. Liquid, with which the image forming apparatus forms an image, is not limited to ink but includes any fluid which may form an image. The image forming apparatus includes a serial-type image forming apparatus in which a liquid discharging head mounted on a carriage scans to form an image and a line-type image forming apparatus including a, line-type liquid discharging head. The liquid discharging device is not limited to a device for forming an image, but includes any device for discharging liquid drops.

Numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims. This patent specification is based on Japanese patent applications No. 2006-318106 filed on Nov. 27, 2006 and No. 2007-286293 filed on Nov. 2, 2007 in the Japan Patent Office, the entire contents of each of which are hereby incorporated herein by reference.

What is claimed is:

1. A liquid discharging device, comprising:

a liquid discharging head configured to discharge a liquid drop, comprising:

a plurality of discharge openings arranged to form a row of discharge openings; and a discharge opening surface on which the row of discharge openings is formed; and a maintenance-recovery mechanism configured to maintain and recover a condition of the liquid discharging head, the maintenance-recovery mechanism comprising:

a blade configured to wipe the discharge opening surface;

a belt configured to carry the blade in a direction of rotation along the row of discharge openings; and a pressing member configured to press an inner circumferential surface of the belt to move a portion of the belt opposing the liquid discharging head toward the liquid discharging head to maintain a substantially constant gap between the blade and the discharge opening surface of the liquid discharging head, the gap having a length in the direction of rotation of the belt not smaller than a length of the row of discharge openings and not greater than a length of the liquid discharging head.

2. The liquid discharging device according to claim 1, wherein the maintenance-recovery mechanism further comprises an adjuster configured to change a distance between the pressing member and the discharge opening surface.

3. The liquid discharging device according to claim 2, wherein the blade wipes the discharge opening surface at least twice and the adjuster reduces the distance between the pressing member and the discharge opening surface in a second wiping.

4. The liquid discharging device according to claim 1, wherein the maintenance-recovery mechanism further comprises a second blade configured to wipe the discharge opening surface after the first blade wipes the discharge opening surface, the first blade having a height greater than a height of the second blade, the second blade avoiding an area on the discharge opening surface lacking the row of discharge openings.

5. The liquid discharging device according to claim 4, wherein the first blade has a thickness smaller than a thickness of the second blade.

6. The liquid discharging device according to claim 4, wherein the second blade has a hardness softer than a hardness of the first blade.

7. The liquid discharging device according to claim 1, wherein the maintenance-recovery mechanism further comprises a second blade configured to wipe the discharge opening surface after the first blade wipes the discharge opening surface, the first blade having a width not smaller than a width of the discharge opening surface, the second blade having a width smaller than the width of the discharge opening surface.

8. The liquid discharging device according to claim 7, wherein the second blade applies more pressure on the discharge opening surface than the first blade does.

9. The liquid discharging device according to claim 1, wherein the maintenance-recovery mechanism further comprises a cleaner configured to remove liquid adhering to the blade, and the belt stops rotating in a state in which the blade contacts the cleaner.

10. The liquid discharging device according to claim 9, wherein the cleaner includes a cleaning liquid, and the belt stops rotating in a state in which at least a head of the blade is immersed in the cleaning liquid.

11. The liquid discharging device according to claim 10, wherein the cleaning liquid is replaceable.

12. The liquid discharging device according to claim 1, wherein the maintenance-recovery mechanism forms an integrated maintenance-recovery unit, comprising:

a cap configured to cap the discharge opening surface; and a housing having a sloped bottom, including a vent provided in a lowermost part of the bottom of the housing.

13. The liquid discharging device according to claim 12, wherein the maintenance-recovery unit further comprises a housing cleaner configured to clean the bottom of the housing; and a housing cleaner belt configured to carry the housing cleaner and move the housing cleaner toward the vent.

14. The liquid discharging device according to claim 13, wherein the maintenance-recovery unit further comprises a driver configured to drive the belt for carrying the blade and the housing cleaner belt for carrying the housing cleaner.

15. The liquid discharging device according to claim 1, wherein the liquid discharging head includes at least one line-type liquid discharging head.

16. The liquid discharging device according to claim l5, wherein the maintenance-recovery mechanism is provided for each one of the at least one line-type liquid discharging head.

17. The liquid discharging device according to claim 1, wherein the maintenance-recovery mechanism further comprises a cleaner configured to remove liquid adhering to the blades, the cleaner comprising:

a cleaning liquid configured to clean the blade;

a cleaning liquid container configured to contain the cleaning liquid; and a cleaning blade configured to remove the liquid adhering to the blade by contacting the blade as the belt carrying the blade rotates and moves the blade through the cleaning liquid.

18. The liquid discharging device according to claim 17, wherein the maintenance-recovery mechanism further comprises:

a pump configured to pump the cleaning liquid in a direction opposite to a direction in which the blade moves through the cleaning liquid in the cleaning liquid container;

a tank comprising:

a filter configured to remove liquid, which is removed from the blade and contained in the cleaning liquid output from the cleaning liquid container, from the cleaning liquid; and a waste liquid container configured to contain the liquid removed by the filter; and a tube connected to the cleaning liquid container and configured to circulate the cleaning liquid through the cleaning liquid container via the tank and the pump.

19. The liquid discharging device according to claim 17, wherein the cleaner further comprises a second cleaning blade, and the entire first and second cleaning blades are immersed in the cleaning liquid, and wherein the first cleaning blade contacts a side surface of the blade to remove liquid adhering to the side surface of the blade and the second cleaning blade removes liquid adhering near a bottom surface of the blade.

20. An image forming apparatus for forming an image on a recording medium, comprising:

a liquid discharging device, comprising:

a liquid discharging head configured to discharge a liquid drop onto a recording medium, comprising:

a plurality of discharge openings arranged to form a row of discharge openings; and a discharge opening surface on which the row of discharge openings is formed; and a maintenance-recovery mechanism configured to maintain and recover a condition of the liquid discharging head, the maintenance-recovery mechanism comprising:

a blade configured to wipe the discharge opening surface;

a belt configured to carry the blade in a direction of rotation along the row of discharge openings; and a pressing member configured to press an inner circumferential surface of the belt to move a portion of the belt opposing the liquid discharging head toward the liquid discharging head to maintain a substantially constant gap between the blade and the discharge opening surface of the liquid discharging head, the gap having a length in the direction of rotation of the belt not smaller than a length of the row of discharge openings and not greater than a length of the liquid discharging head.

* * * * *